US010780566B2

(12) United States Patent
Su

(10) Patent No.: US 10,780,566 B2
(45) Date of Patent: Sep. 22, 2020

(54) PNEUMATIC TOOL

(71) Applicant: Basso Industry Corp., Taichung (TW)

(72) Inventor: San-Yih Su, Taichung (TW)

(73) Assignee: Basso Industry Corp., Taichung (TW)

( * ) Notice: Subject to any disclaimer, the term of this patent is extended or adjusted under 35 U.S.C. 154(b) by 653 days.

(21) Appl. No.: 15/244,070

(22) Filed: Aug. 23, 2016

(65) Prior Publication Data

US 2017/0057076 A1 Mar. 2, 2017

(30) Foreign Application Priority Data

Aug. 25, 2015 (TW) ..... 104127702 A

(51) Int. Cl.
*B25F 5/02* (2006.01)
*B25B 21/00* (2006.01)
*B25F 5/00* (2006.01)

(52) U.S. Cl.
CPC ..... *B25F 5/02* (2013.01); *B25B 21/004* (2013.01); *B25F 5/005* (2013.01)

(58) Field of Classification Search
CPC ..... B25F 5/02; B25F 5/005; B25B 21/004
USPC ..... 173/168, 169, 218
See application file for complete search history.

(56) References Cited

U.S. PATENT DOCUMENTS 3,635,605 A * 1/1972 Hall ..... B23B 45/04 417/315
3,709,630 A * 1/1973 Pohl ..... A61B 17/1628 415/199.5
3,713,321 A * 1/1973 LaPointe ..... B21J 15/20 29/243.524
4,308,926 A * 1/1982 Montabert ..... B25D 17/245 173/162.1
6,532,635 B1 * 3/2003 Gregory ..... B21J 15/043 29/243.523
7,448,524 B1 * 11/2008 Liang ..... B25C 1/044 227/120
2002/0104666 A1 * 8/2002 McCallops ..... B25F 5/02 173/168
2003/0070301 A1 * 4/2003 Herrmann ..... B25F 5/00 30/276
2006/0150402 A1 * 7/2006 Lin ..... B21J 15/105 29/812.5

(Continued)

FOREIGN PATENT DOCUMENTS

EP 1302282 A2 4/2003
TW M444900 U 1/2013
TW M444900 U1 1/2013

OTHER PUBLICATIONS

European Search Report in corresponding EP application No. 16185147 dated Mar. 2, 2017 (5 pages).

*Primary Examiner* — Nathaniel C Chukwurah
*Assistant Examiner* — Mobeen Ahmed
(74) *Attorney, Agent, or Firm* — Burris Law, PLLC

(57) ABSTRACT

A pneumatic tool includes a main body unit, a control valve unit, a switch unit and a trigger unit. The main body unit has a flow path for guiding inflow of air. The control valve unit removably blocks the flow path. The switch unit includes a sleeve member movable between an open position where the control valve unit is driven to unblock the flow path, and a block position where the control valve unit is driven to block the flow path. The trigger unit includes a trigger member operable to move the sleeve member between the open position and the block position.

19 Claims, 18 Drawing Sheets

(56) References Cited

U.S. PATENT DOCUMENTS

| | | | | |
|---|---|---|---|---|
| 2007/0114049 | A1* | 5/2007 | Steverding | F16P 3/20 173/4 |
| 2013/0075123 | A1* | 3/2013 | Sun | B25F 5/00 173/221 |
| 2013/0298755 | A1 | 11/2013 | Su et al. | |
| 2013/0316626 | A1* | 11/2013 | Yaschur | B24B 23/026 451/344 |
| 2014/0060872 | A1* | 3/2014 | Ting | B25F 5/02 173/218 |
| 2015/0014014 | A1* | 1/2015 | Wilcox | B25F 5/005 173/218 |

* cited by examiner

PNEUMATIC TOOL

CROSS-REFERENCE TO RELATED APPLICATION

This application claims priority of Taiwanese Patent Application No. 104127702, filed on Aug. 25, 2015.

FIELD

The disclosure relates to a pneumatic tool, and more particularly to a pneumatic tool having a trigger unit.

BACKGROUND

Referring to FIGS. 1 and 2, Taiwanese Utility Model Patent No. M444900 discloses a conventional pneumatic tool including a first part 11 that has two connecting grooves 111, a second part 12 that has two connecting holes 121, two connecting members 13 each of which is removably inserted into a respective one of the connecting grooves 111 and a respective one of the connecting holes 121 for separably interconnecting the first and second parts 11, 12, a valve rod 14 that is movably mounted to the first part 11 for guiding inflow of air, a trigger member 15 that is mounted to the first part 11 and that is movable to switch the valve rod 14, and a tool head 16 that is mounted to the second part 12 for outputting power. By removing the connecting members 13, the first and second parts 11, 12 are rotatable relative to each other so as to adjust the relative position between the tool head 16 and the trigger member 15.

However, during assembly of the first part 11 of the conventional pneumatic tool, the trigger member 15 must be positioned relative to the valve rod 14 such that the valve rod 14 is located on the moving path of the trigger member 15. Such assembly process is inconvenient.

Moreover, since the first and second parts 11, 12 are separable, a pressure drop may easily occur when a gap between the first and second parts 11, 12 is not air-tightly sealed. The operation to rotate the first and second parts 11, 12 relative to each other is inconvenient, and the connecting members 13 may easily get lost during such operation.

SUMMARY

Therefore, an object of the disclosure is to provide a pneumatic tool that can alleviate at least one of the drawbacks of the prior art.

According to the disclosure, the pneumatic tool includes a main body unit, a control valve unit, a switch unit and a trigger unit. The main body unit has a flow path that extends from a rear end of the main body unit toward a front end of the main body unit for guiding inflow of air, and an annular space that surrounds the flow path. The control valve unit is disposed at the main body unit for removably blocking the flow path. The switch unit includes a sleeve member that surrounds the control valve unit and that is movably disposed in the annular space. The sleeve member is movable relative to the main body unit between an open position where the control valve unit is driven to unblock the flow path, and a block position where the control valve unit is driven to block the flow path. The trigger unit includes a trigger member that is disposed on an outer surface of the main body unit and that is operable to move the sleeve member of the switch unit between the open position and the block position.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
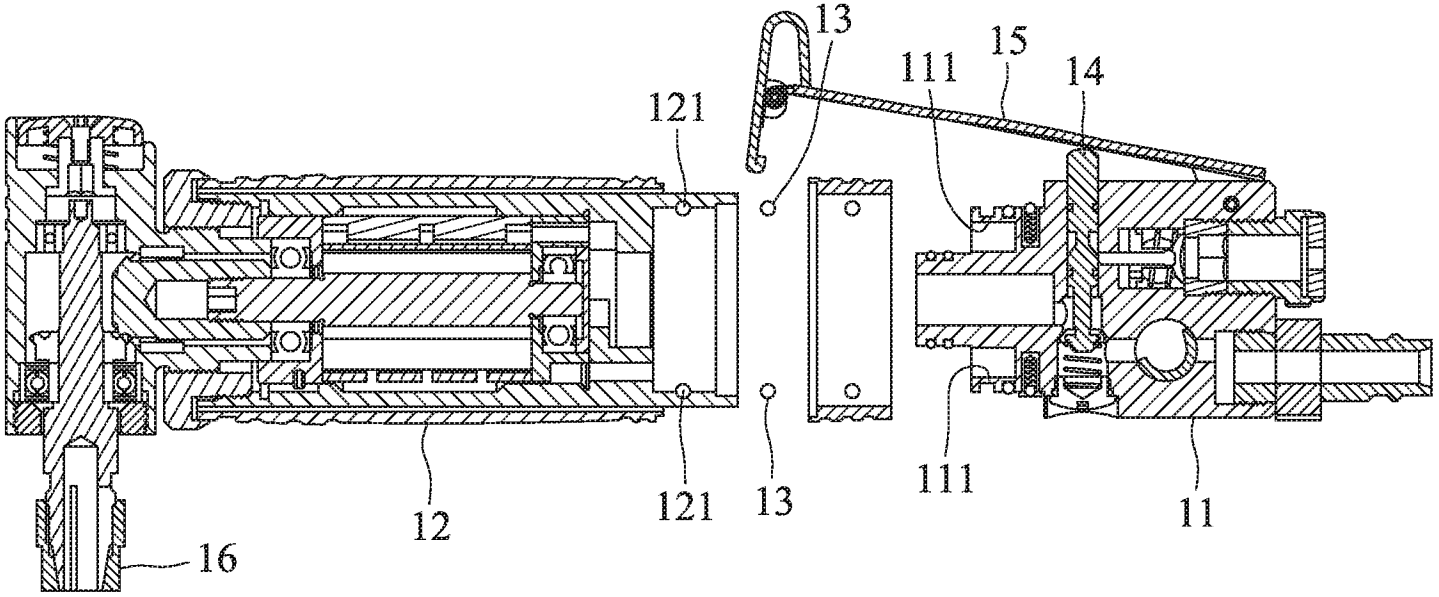
FIG. 1 PRIOR ART
FIG. 1 is a partly exploded sectional view illustrating a conventional pneumatic tool disclosed in Taiwanese Utility Model Patent No. M444900.
Figure 2:
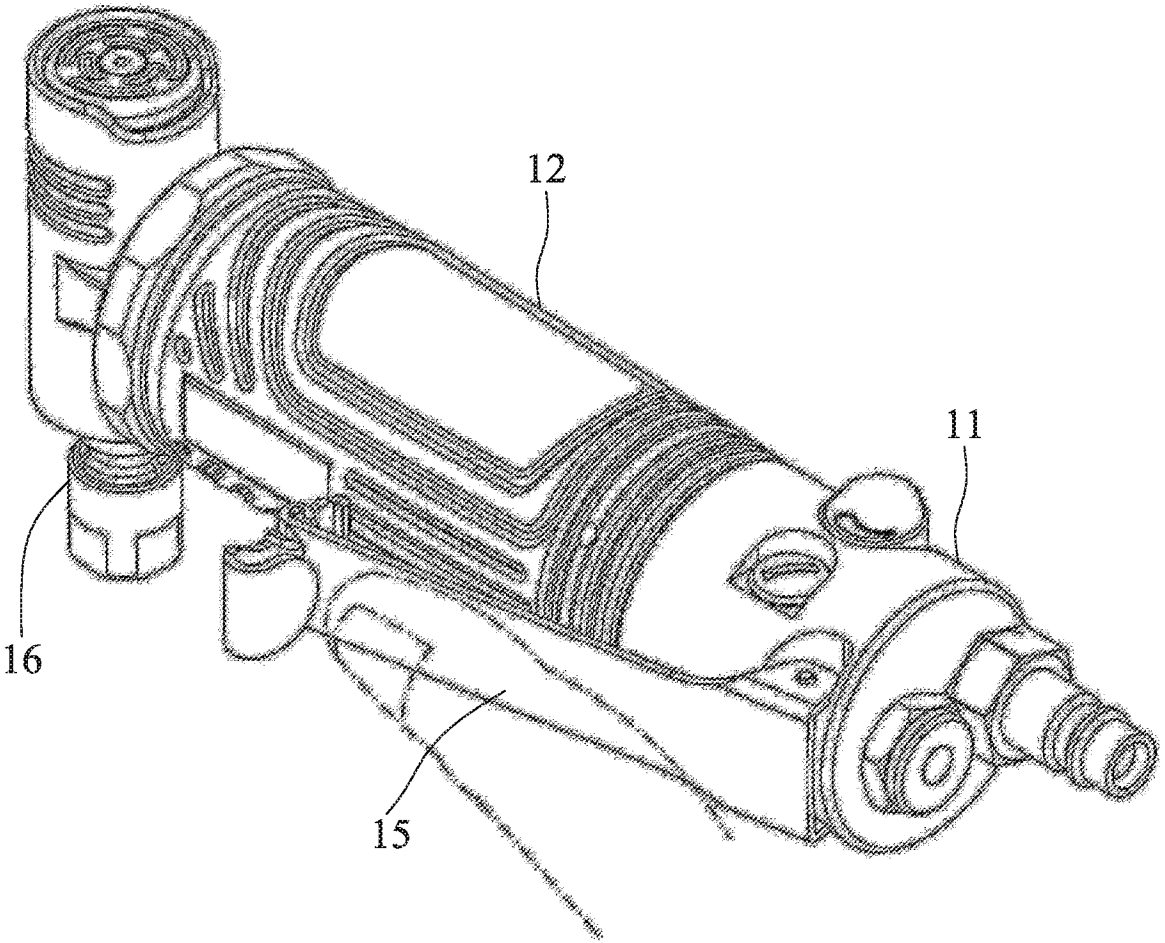
FIG.2 PRIOR ART
FIG. 2 is a schematic perspective view illustrating the conventional pneumatic tool.
Figure 3:
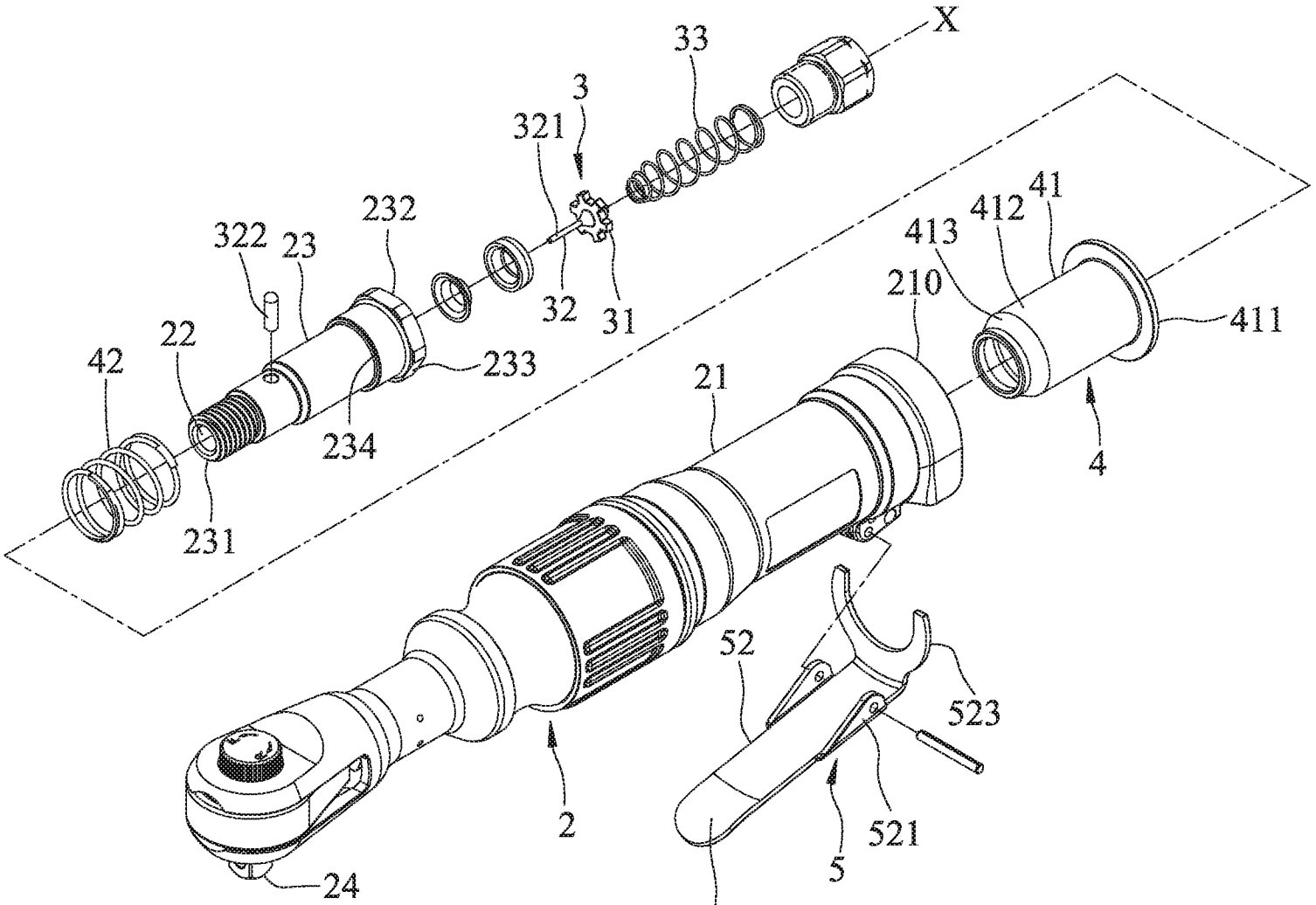
FIG. 3 is an exploded perspective view illustrating a first embodiment of the pneumatic tool according to the disclosure.
Figure 4:
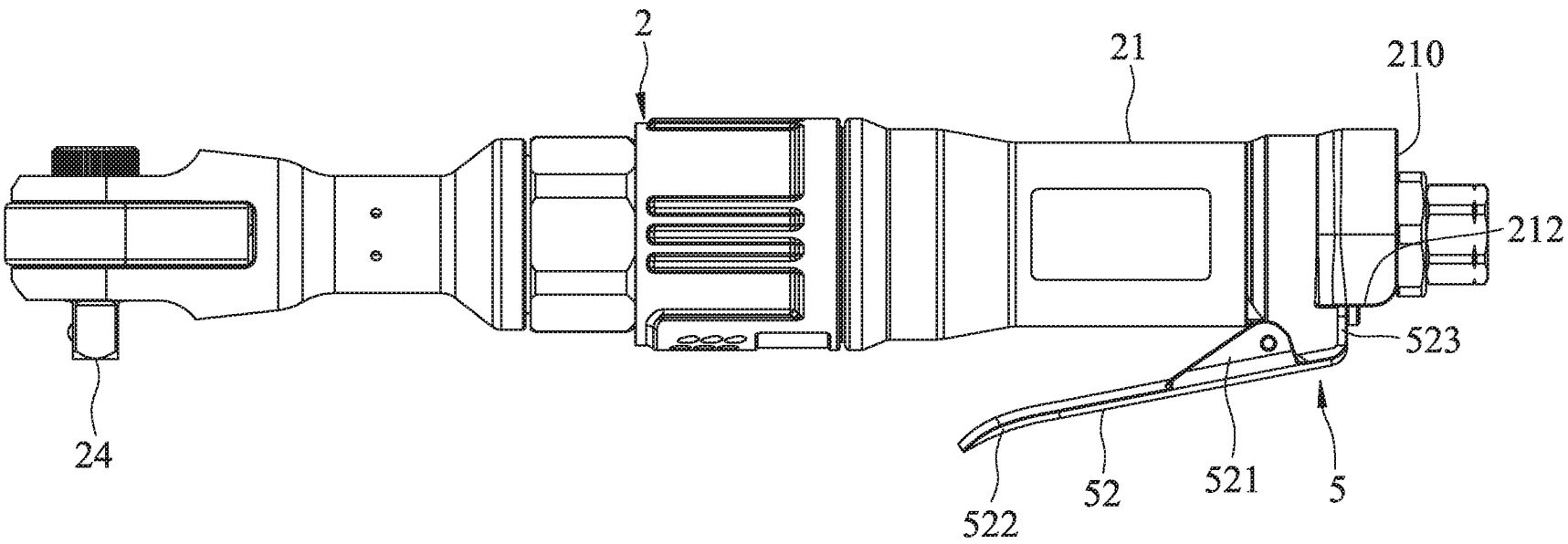
FIG. 4 is a side view illustrating the first embodiment.

Before the disclosure is described in greater detail, it should be noted that where considered appropriate, reference numerals or terminal portions of reference numerals have been repeated among the figures to indicate corresponding or analogous elements, which may optionally have similar characteristics.

Referring to FIGS. 3 to 6, the first embodiment of the pneumatic tool according to the disclosure includes a main body unit 2, a control valve unit 3, a switch unit 4 and a trigger unit 5.

The main body unit 2 includes a hollow main body 21, a tubular member 23 that is surrounded by the main body 21 and that surrounds an axis (X) to define a flow path 22, and a tool head 24 that is mounted to a front portion of the main body 21 for outputting power. The main body 21 has an opening 212 formed at a rear portion 210 thereof. The tubular member 23 cooperates with the main body 21 to define an annular space 230 therebetween, and has a front end 231 that is inserted into the main body 21, a rear end 232 that is disposed out of the main body 21, a stop flange 233 that extends radially and outwardly and that is proximate to the rear end 232, and a step surface 234 that faces toward the front end 231 and that is proximate to the stop flange 233. The flow path 22 extends from the rear end 232 to the front end 231 for guiding air to flow into the main body 21.

The control valve unit 3 includes a valve member 31 that removably blocks the flow path 22 of the main body unit 2, an actuating rod assembly 32, and a basing member 33 that is connected to the valve member 31 and that is disposed in the tubular member 23. The actuating rod assembly 32 includes a rod 321 that is co-movably connected to the valve member 31 and that extends along the axis (X), and a pin 322 that is movably mounted to the tubular member 23 and that has an end abutting against the rod 321 and an opposite end extending out from the tubular member 23. The basing member 33 resiliently biases the valve member 31 to block the flow path 22. In this embodiment, the basing member 33 is configured as a spring, and the pin 322 is movable in a direction perpendicular to the direction of the axis (X).

The switch unit 4 includes a sleeve member 41 that surrounds the tubular member 23 and that is movably and partially disposed in the annular space 230, and a restoring member 42. The sleeve member 41 has a flange segment 411 that is disposed out of the tubular member 23, a main segment 412 that is connected to the flange segment 411, a convergent segment 413 that is connected to an end of the main segment 412 distal from the flange segment 411, and a stop surface 414 that is formed in the main segment 412 and that faces toward the flange segment 411. The inner diameter of the end of the main segment 412 distal from the flange segment 411 is greater than the inner diameter of the convergent segment 413. The sleeve member 41 is movable relative to the tubular member 23 between a block position (see FIG. 5) where the pin 322 of the actuating rod assembly 32 of the control valve unit 3 corresponds in position to an inner surface of the end of the main segment 412 distal from the flange segment 411, and an open position (see FIG. 6) where the pin 322 is in contact with an inner surface of the convergent segment 413. The restoring member 42 has two opposite ends respectively abutting against the step surface 234 of the tubular member 23 and the stop surface 414 of the sleeve member 41, and resiliently biases the sleeve member 41 toward the block position. In this embodiment, the restoring member 42 is configured as a compression spring. The movement of the sleeve member 41 relative to the tubular member 23 is limited by the stop flange 233 of the tubular member 23.

The trigger unit 5 includes a trigger member 52 that is disposed on an outer surface of the main body 21 of the main body unit 2. The trigger member 52 has a pivoted portion 521 that is pivoted to the main body 21, and an operating portion 522 and an actuating portion 523 that are respectively located at two opposite sides of the pivoted portion 521. The operating portion 522 is operable to pivot relative to the main body 21 about a pivoted point of the pivoted portion 521 between a released position (see FIG. 5) where the operating portion 522 is distal from the main body 21, and a pressed position (see FIG. 6) where the operating portion 522 is proximate to the main body 21. The actuating portion 523 is C-shaped, extends into the opening 212 of the main body 21, and abuts against the flange segment 411 of the sleeve member 41.

Figure 5:
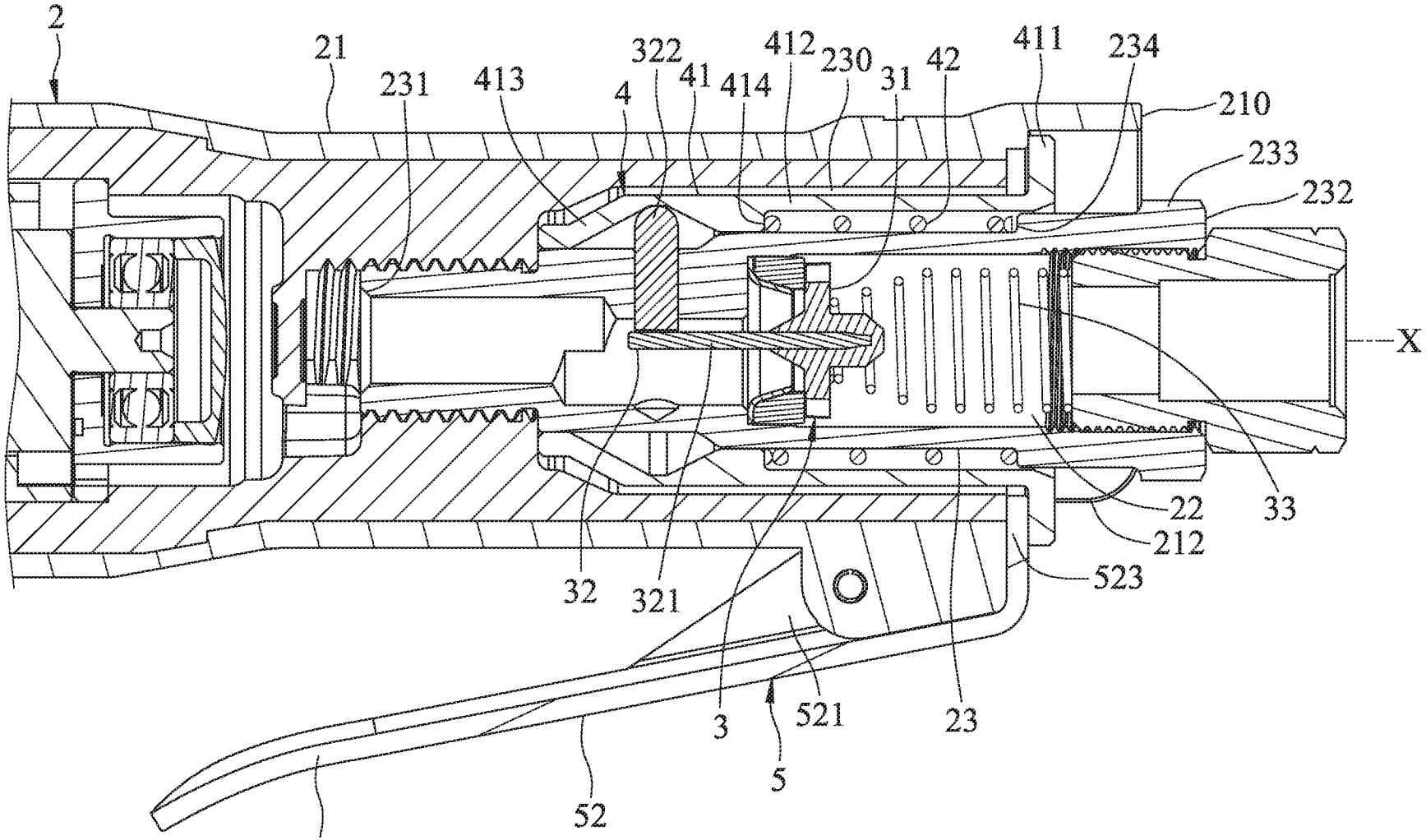
FIG. 5 is a schematic fragmentary sectional view illustrating a sleeve member of the first embodiment at a block position.

Referring to FIG. 5, when the operating portion 522 of the trigger member 52 is not subjected to an external force and is at the released position, the sleeve member 41 is maintained at the block position by the restoring member 42. At this time, the actuating portion 523 of the trigger member 52 abuts against the flange segment 411 of the sleeve member 41, and the inner surface of the end of the main segment 412 distal from the flange segment 411 corresponds in position to the pin 322 of the actuating rod assembly 32 of the control valve unit 3 and is not in contact with the pin 322. By such, the valve member 31 is resiliently biased by the basing member 33 to block the flow path 22 so as to prevent air from flowing into the main body 21.

Figure 6:
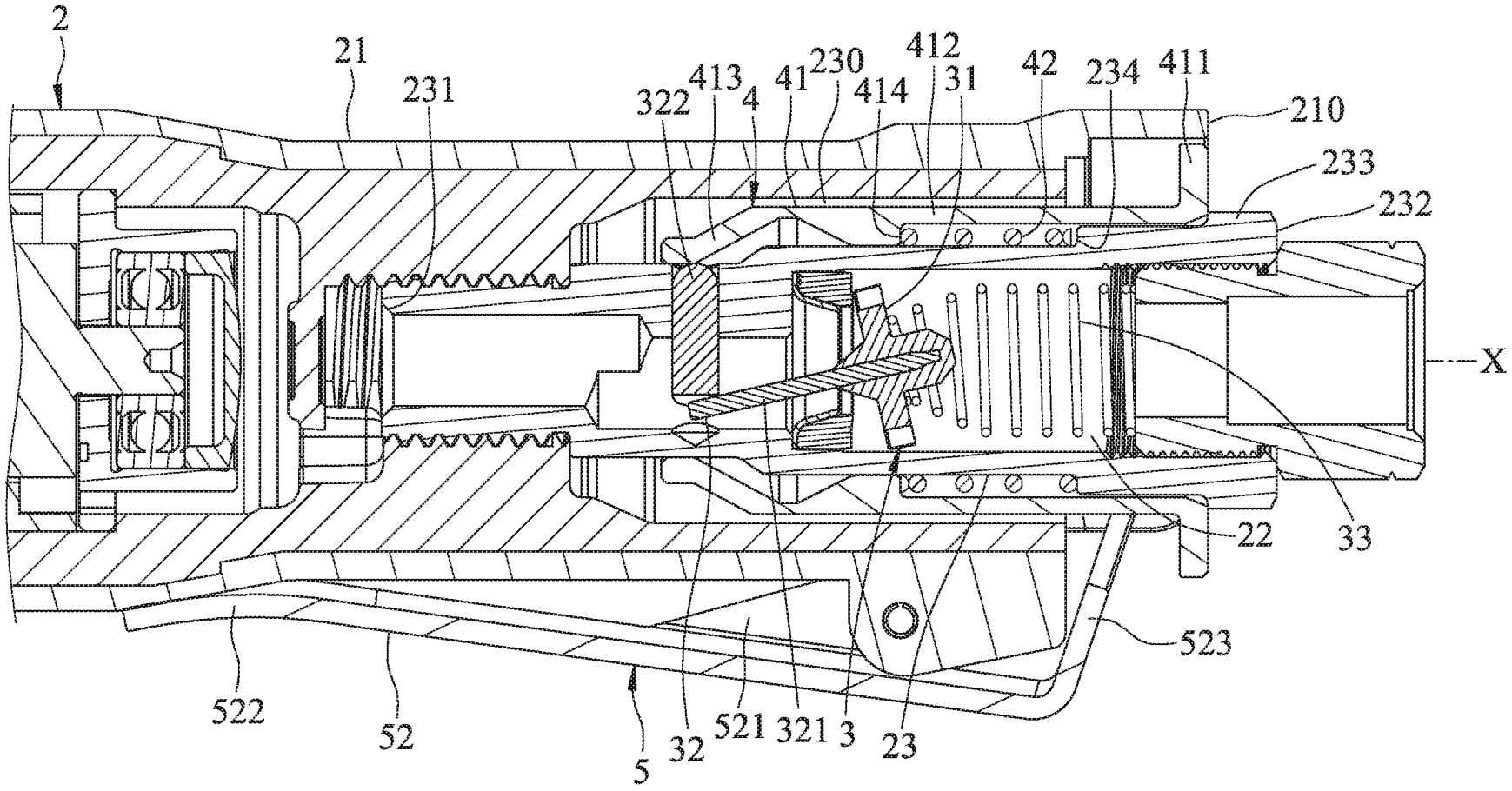
FIG. 6 is another schematic fragmentary sectional view illustrating the sleeve member of the first embodiment at an open position.
Figure 7:
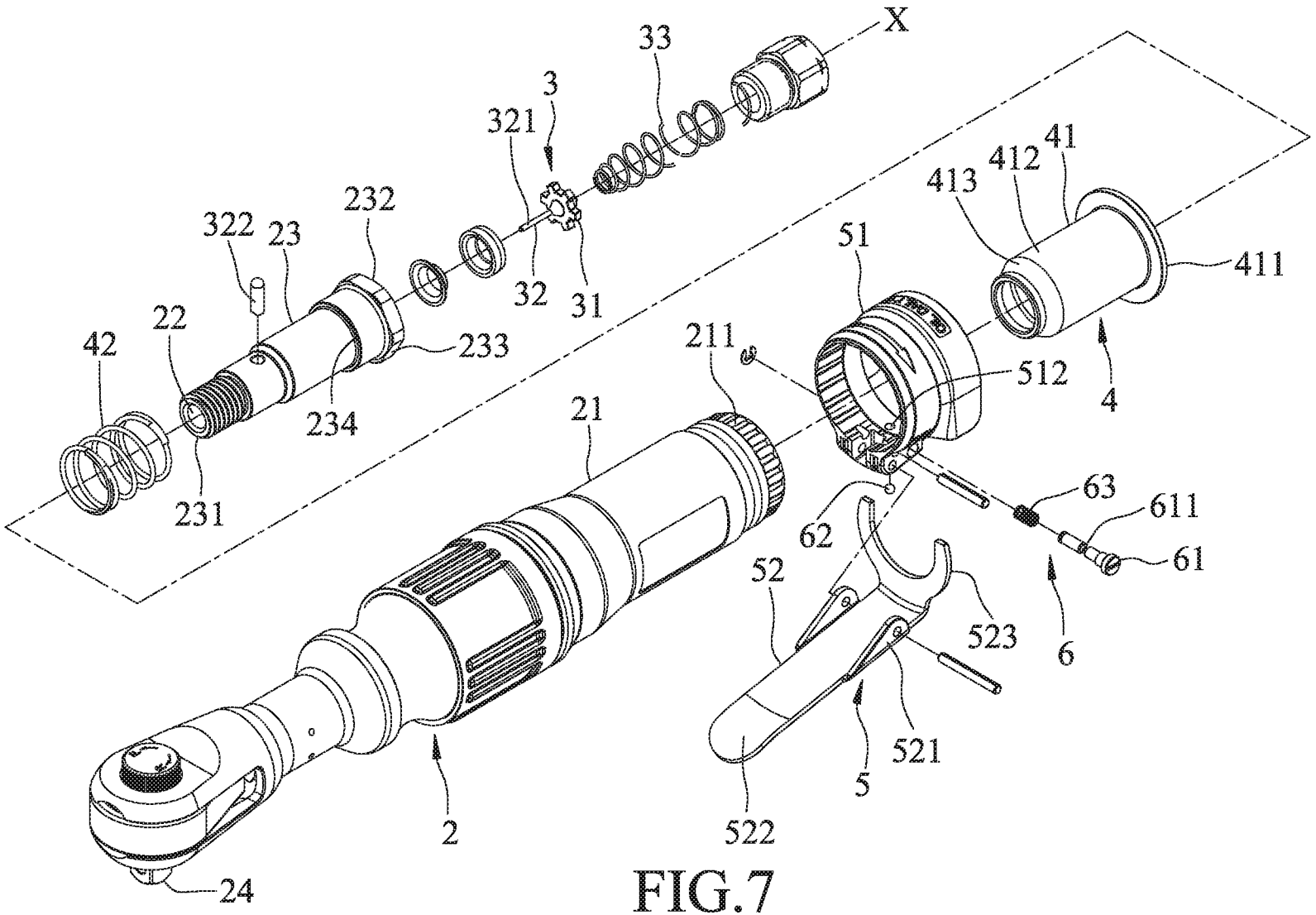
FIG. 7 is an exploded perspective view illustrating a second embodiment of the pneumatic tool according to the disclosure.
Figure 8:
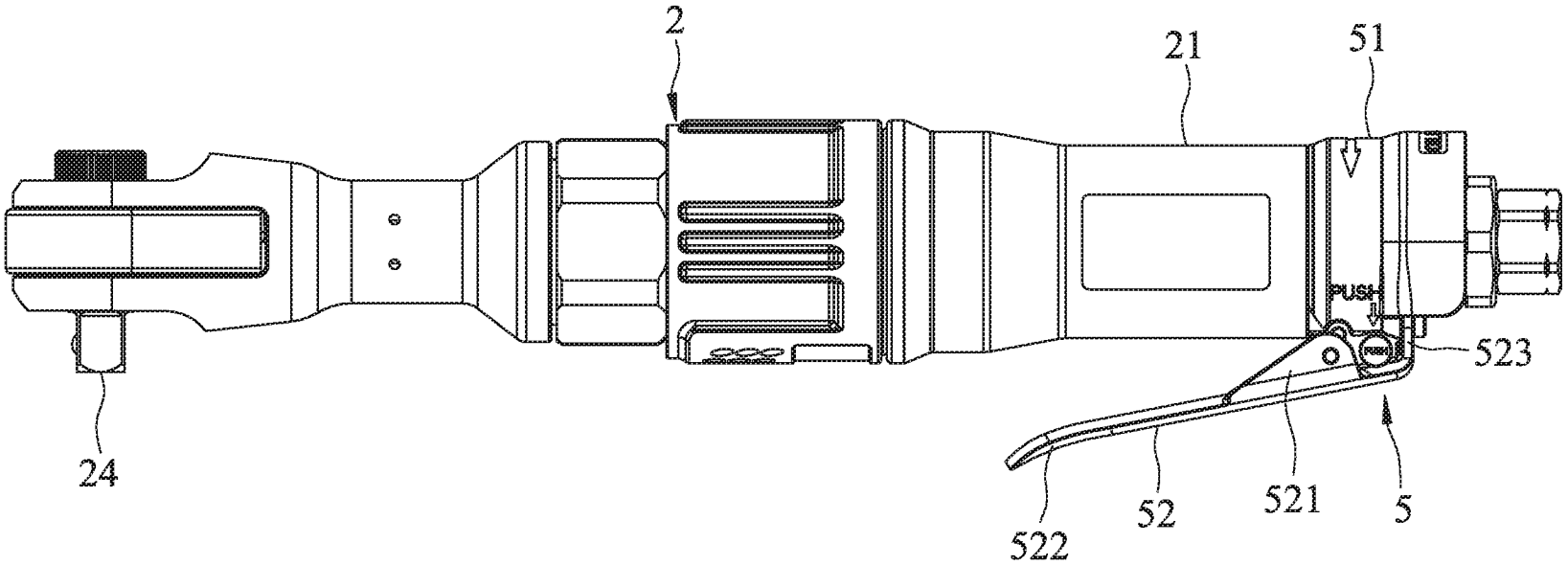
FIG. 8 is a side view illustrating the second embodiment.
Figure 9:
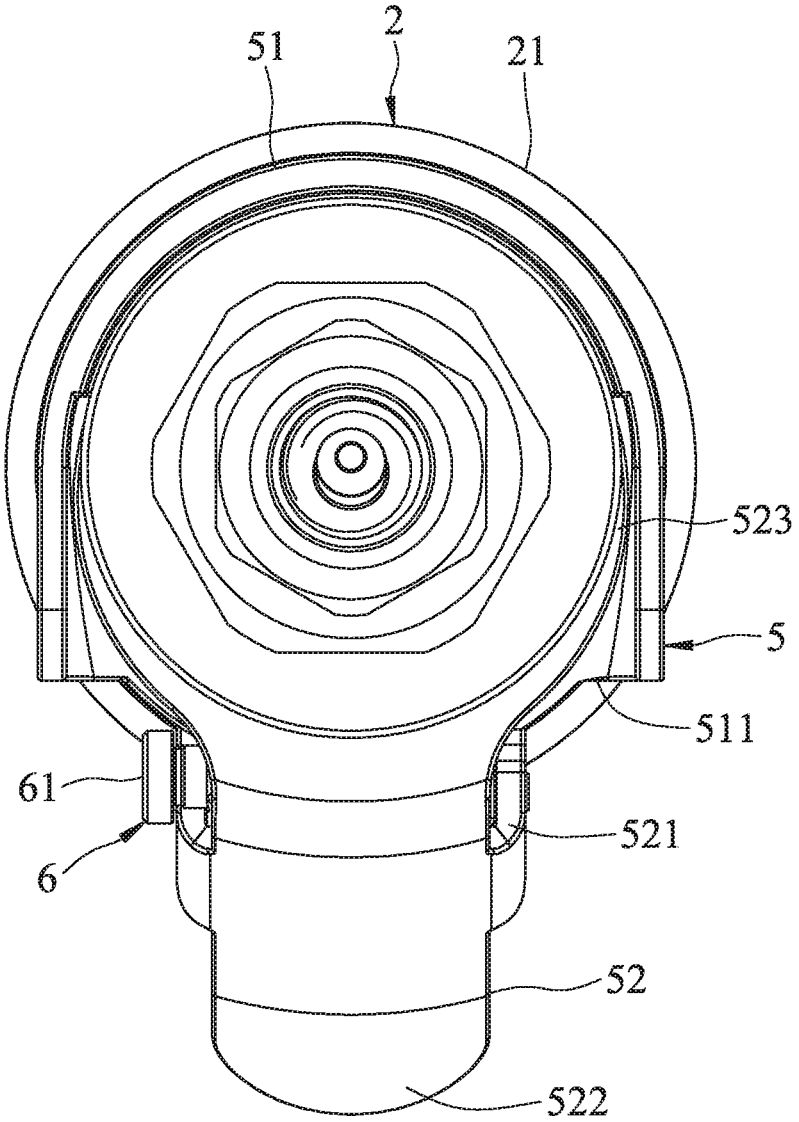
FIG. 9 is another side view illustrating the second embodiment.

Referring to FIG. 6, when the operating portion 522 of the trigger member 52 is pressed to move to the pressed position, the actuating portion 523 of the trigger member 52 pushes the flange segment 411 of the sleeve member 41 so as to move the sleeve member 41 to the open position against the basing action of the restoring member 42. At this time, the inner surface of the convergent segment 413 is in contact with the pin 322 of the actuating rod assembly 32 of the control valve unit 3, and pushes the pin 322 to move the rod 321 and the valve member 31 to unblock the flow path 22, so as to permit air to flow into the main body 21.

Referring to FIGS. 7 to 10, the second embodiment of the pneumatic tool according to the disclosure is similar to the first embodiment, and includes a main body unit 2, a control valve unit 3, a switch unit 4, a trigger unit 5 and a positioning unit 6.

The main body 21 of the main body unit 2 further has a plurality of angularly spaced-apart positioning grooves 211 that are from in an outer surface of the rear portion 210 of the main body 21.

The trigger unit 5 further includes an annular rotating member 51 that rotatably surrounds the main body 21 and that is formed with an opening 511 (see FIG. 9) permitting the actuating portion 523 of the trigger member 52 to extend thereinto. The annular rotating member 51 has a mounting hole 512 that is operable to be aligned with one of the positioning grooves 211. The pivoted portion 521 of the trigger member 52 is pivoted to the annular rotating member 51. The operating portion 522 is operable to pivot relative to the main body 21 about a pivoted point of the pivoted portion 521 between a released position (see FIG. 10) where the operating portion 522 is distal from the main body 21, and a pressed position (see FIG. 11) where the operating portion 522 is proximate to the main body 21.

The positioning unit 6 includes a bolt member 61 that is movably mounted to the annular rotating member 51, a ball member 62 that is movably disposed in the mounting hole 512 of the annular rotating member 51, and a resilient member 63 that has two opposite ends respectively abut against the annular rotating member 51 and the bolt member 61. The bolt member 61 has a recess 611 that is formed in an outer surrounding surface thereof, and is movable between a fixing position (see FIG. 12) where the recess 611 is misaligned from the mounting hole 512, and an adjusting position (see FIG. 13) where the recess 611 is aligned with the mounting hole 512. The resilient member 63 resiliently biases the bolt member 61 toward the fixing position.

Figure 10:
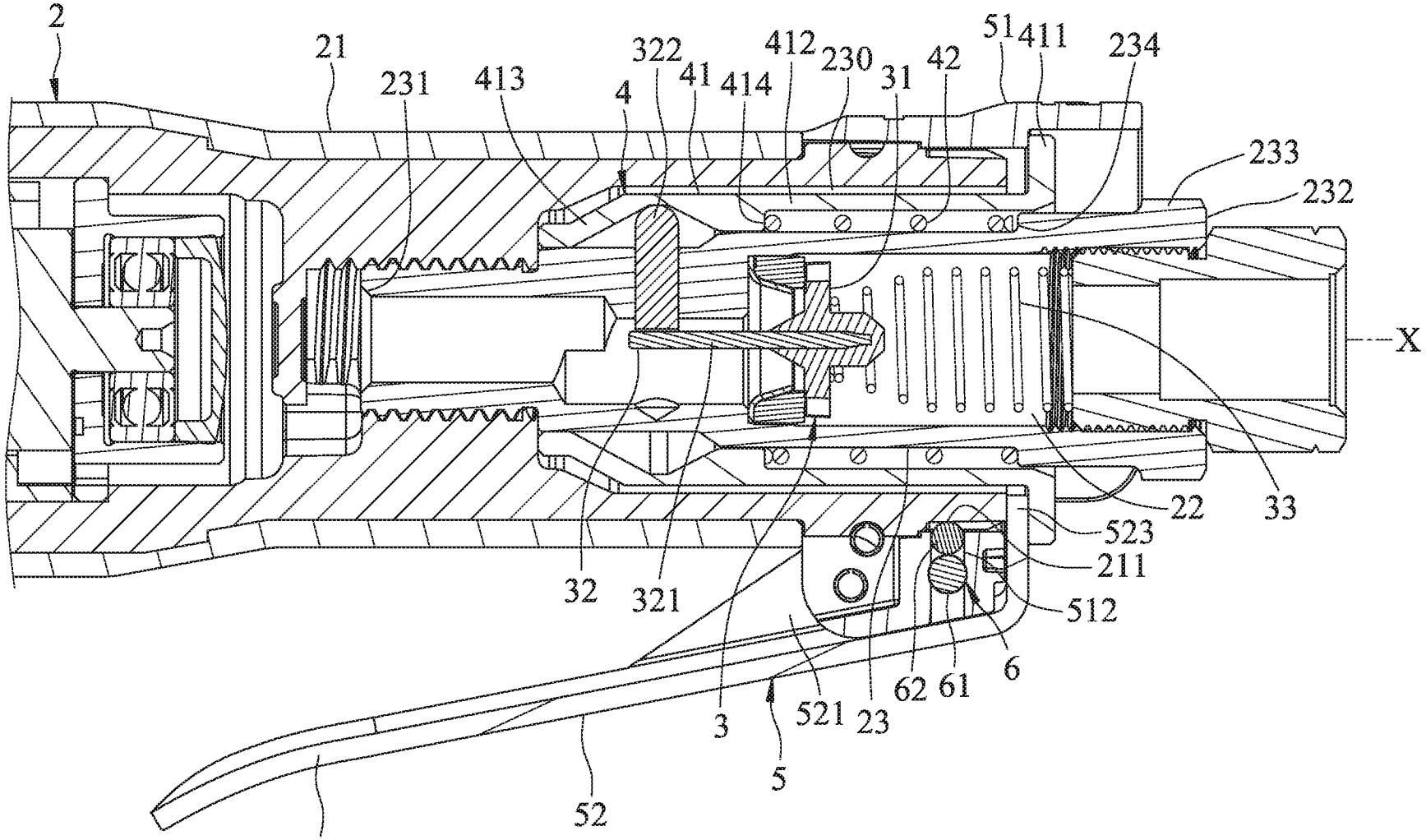
FIG. 10 is a schematic fragmentary sectional view illustrating a sleeve member of the second embodiment at a block position.

Referring to FIG. 10, when the operating portion 522 of the trigger member 52 is not subjected to an external force and is at the released position, the sleeve member 41 is maintained at the block position by the restoring member 42. At this time, the actuating portion 523 of the trigger member 52 abuts against the flange segment 411 of the sleeve member 41, and the inner surface of the end of the main segment 412 distal from the flange segment 411 corresponds in position to the pin 322 of the actuating rod assembly 32 of the control valve unit 3 and is not in contact with the pin 322. By such, the valve member 31 is resiliently biased by the basing member 33 to block the flow path 22 so as to prevent air from flowing into the main body 21.

Figure 11:
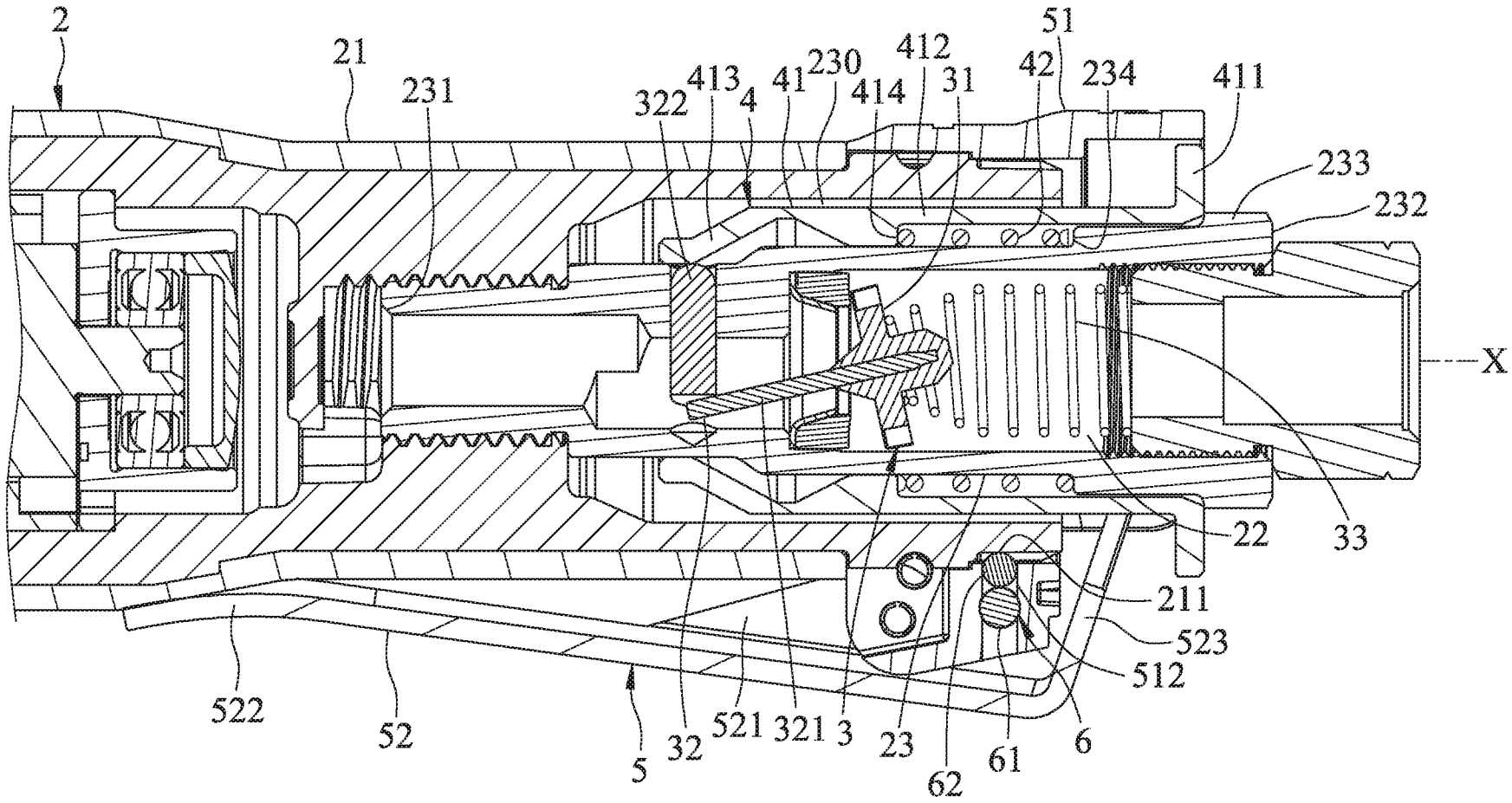
FIG. 11 is another schematic fragmentary sectional view illustrating the sleeve member of the second embodiment at an open position.

Referring to FIG. 11, when the operating portion 522 of the trigger member 52 is pressed to move to the pressed position, the actuating portion 523 of the trigger member 52 pushes the flange segment 411 of the sleeve member 41 so as to move the sleeve member 41 to the open position against the basing action of the restoring member 42. At this time, the inner surface of the convergent segment 413 is in contact with the pin 322 of the actuating rod assembly 32 of the control valve unit 3, and pushes the pin 322 to move the rod 321 and the valve member 31 to unblock the flow path 22, so as to permit air to flow into the main body 21.

Figure 12:
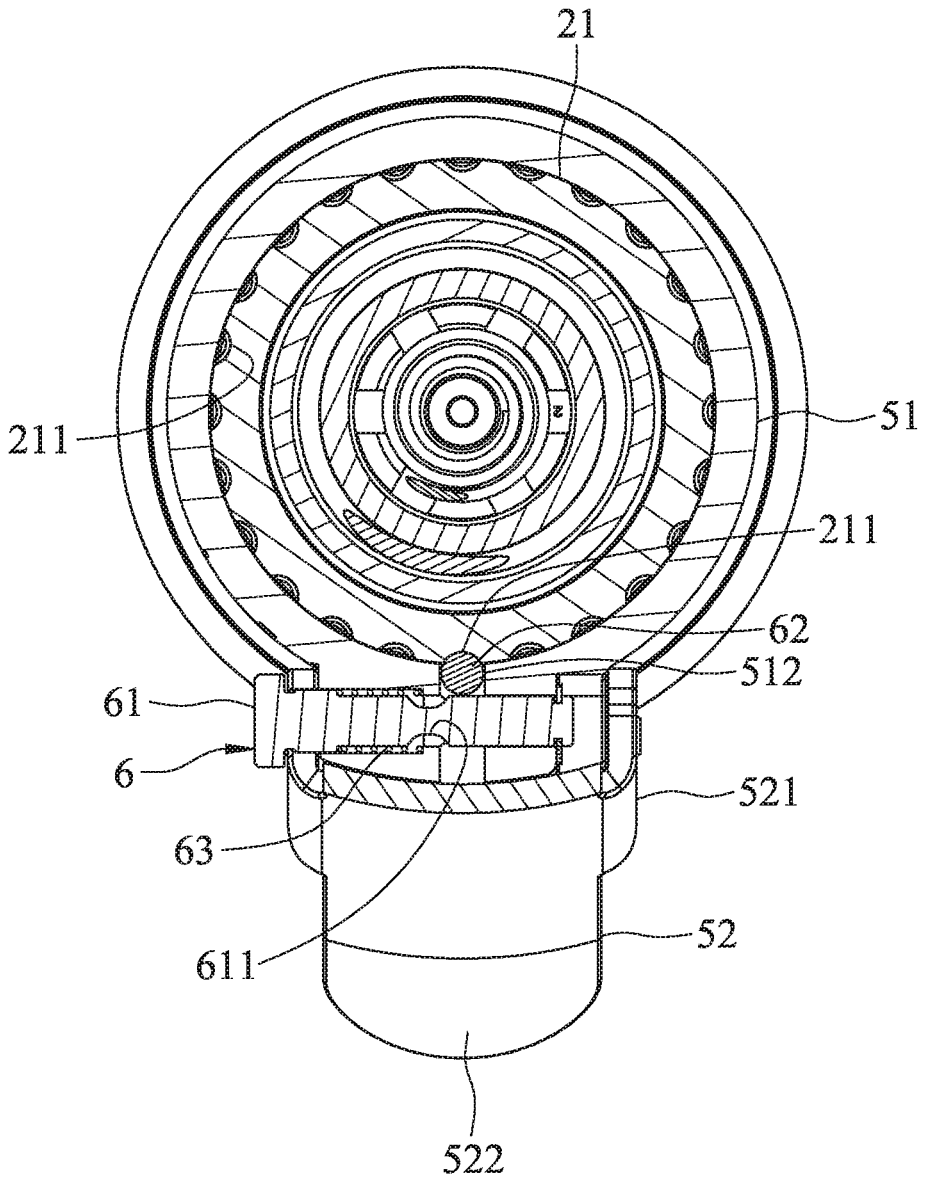
FIG. 12 is a schematic sectional view illustrating a bolt member of the second embodiment at a fixing position.

Referring to FIGS. 10 and 12, when the bolt member 61 is not pressed, the resilient member 63 maintains the bolt member 61 at the fixing position where the recess 611 is misaligned from the mounting hole 512, so that the ball member 62 is pushed by the outer surrounding surface of the bolt member 61 to engage with one of the positioning grooves 211 that is registered with the mounting hole 512 so as to prevent the annular rotating member 51 from rotating relative to the main body 21.

Figure 13:
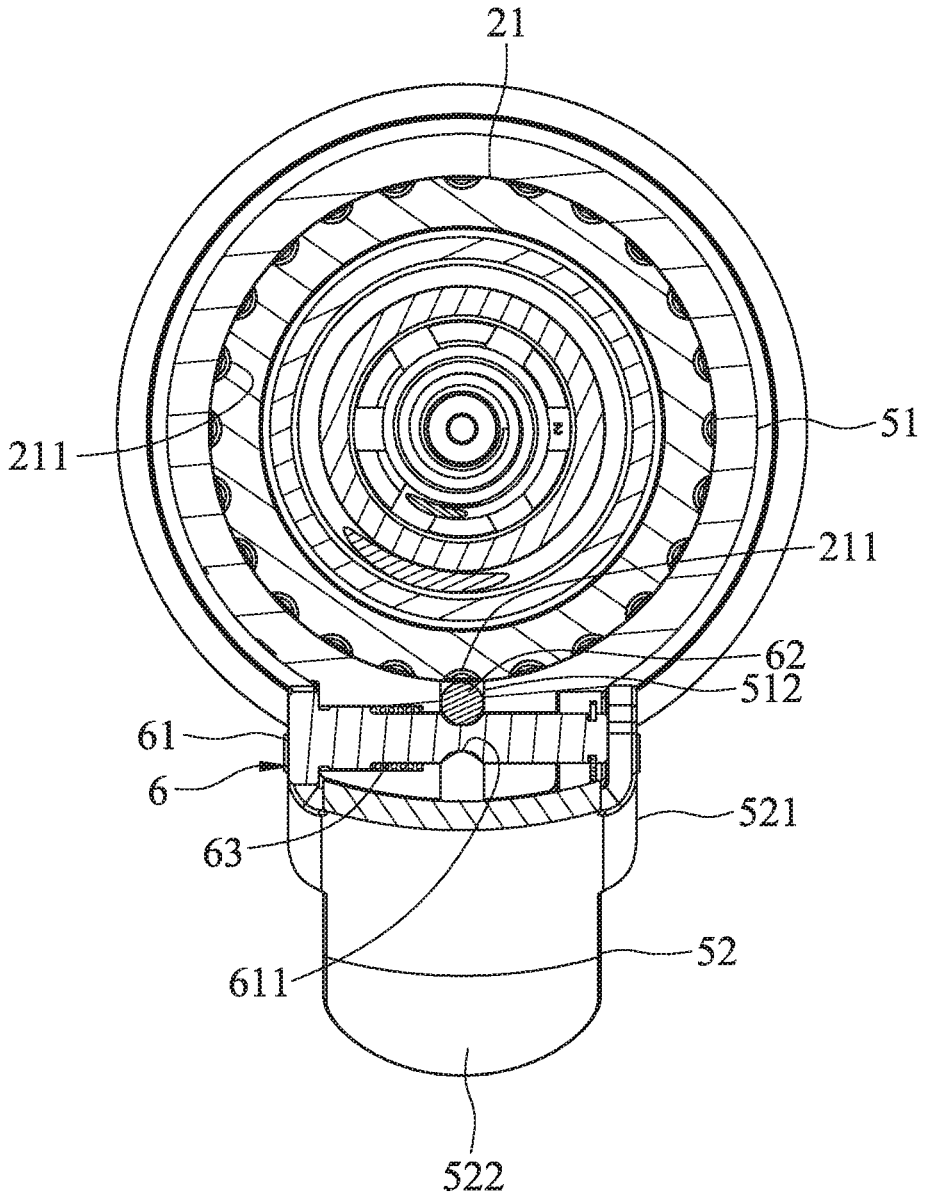
FIG. 13 is another schematic sectional view illustrating the bolt member of the second embodiment at an adjusting position for rotating an annular rotating member relative to a main body.
Figure 14:
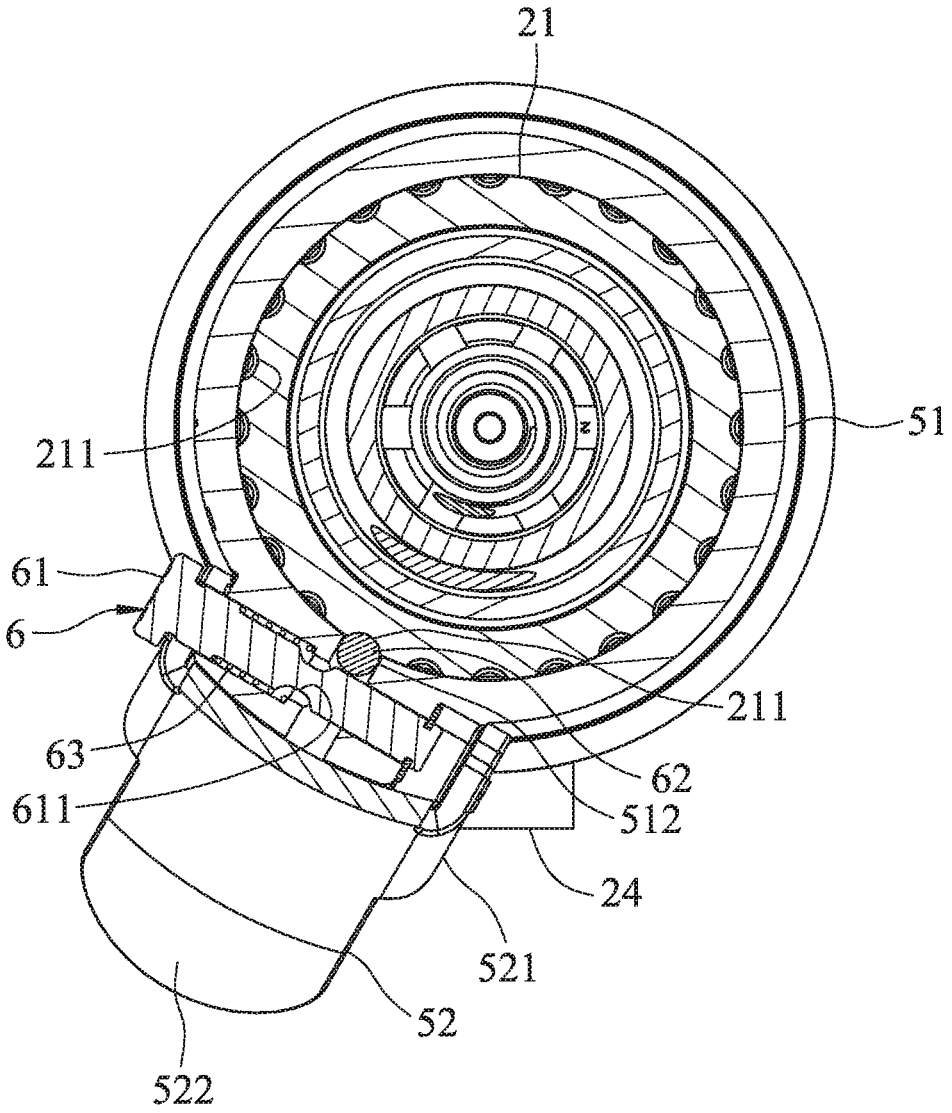
FIG. 14 is still another schematic sectional view illustrating the bolt member of the second embodiment at a fixing position after the annular rotating member being rotated.

Referring to FIGS. 13 and 14, when the bolt member 61 is pressed to move to the adjusting position against the biasing action of the resilient member 63 such that the recess 611 is aligned with the mounting hole 512, the ball member 62 is permitted to disengage from the one of the positioning grooves 211 that is registered with the mounting hole 512 and moves into the recess 611, so that the annular rotating member 51 is permitted to rotate relative to the main body 21 until the bolt member 61 is moved back to the fixing position (see FIG. 14).

Figure 15:
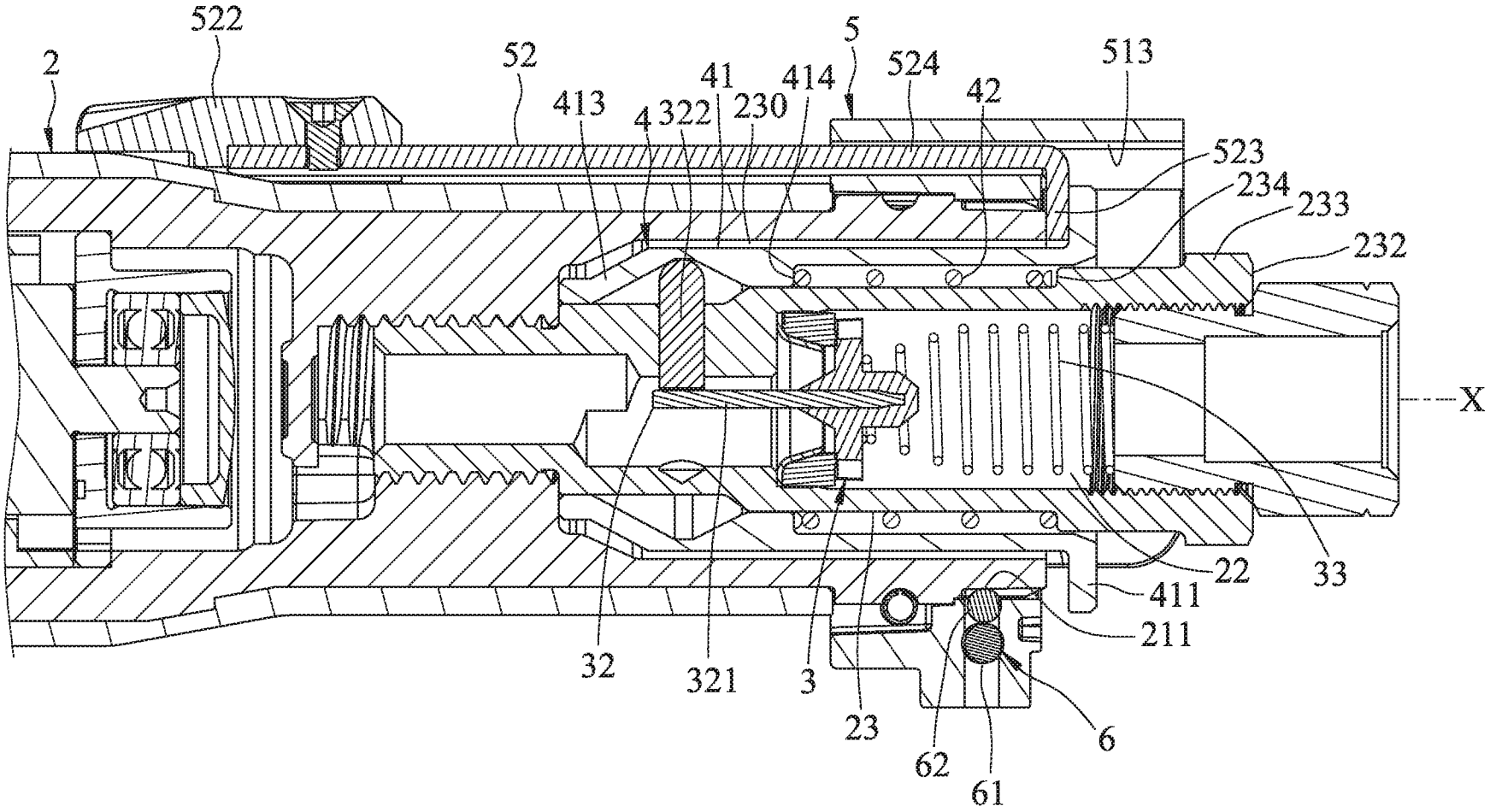
FIG. 15 is a schematic fragmentary sectional view illustrating a third embodiment of the pneumatic tool according to the disclosure where a sleeve member is at a block position.
Figure 16:
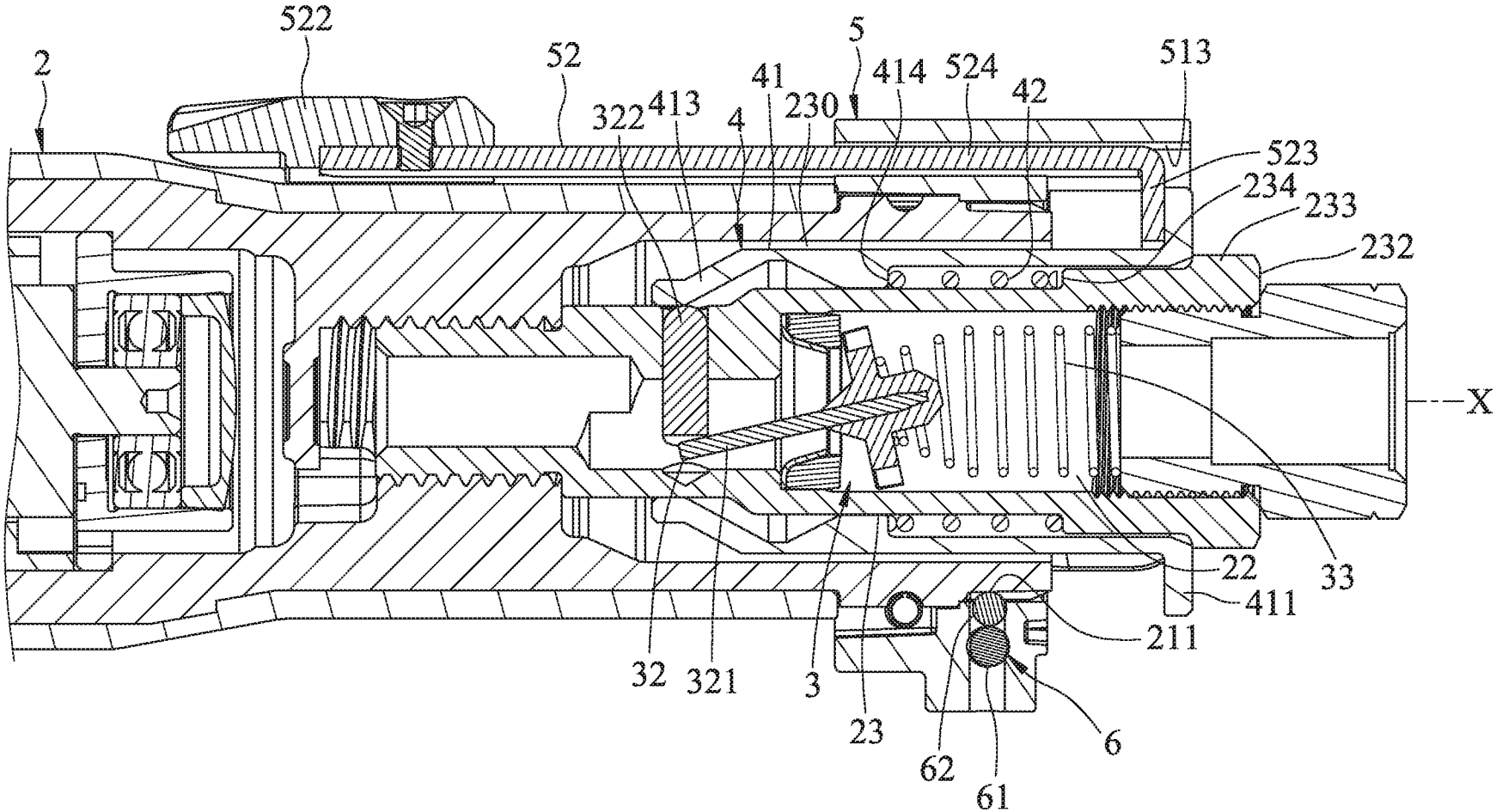
FIG. 16 is another schematic fragmentary sectional view illustrating the sleeve member of the third embodiment at an open position.

Referring to FIGS. 15 and 16, the third embodiment of the pneumatic tool according to the disclosure is similar to the second embodiment, and includes a main body unit 2, a control valve unit 3, a switch unit 4, a trigger unit 5 and a positioning unit 6.

The annular rotating member 51 has a slide groove 513 that is formed in an inner surface thereof.

The trigger member 52 has a connecting portion 524 that is movable within the slide groove 513, and an operating portion 522 and an actuating portion 523 that are respectively located at two opposite sides of the connecting portion 524. The operating portion 522 is operable to move relative to the main body 21 between a released position (see FIG. 15) where the sleeve member 41 is at the block position, and a pressed position (see FIG. 16) where the sleeve member 41 is at the open position.

By such, when the operating portion 522 of the trigger member 52 is pressed to move from the released position to the pressed position, the actuating portion 523 of the trigger member 52 pushes the flange segment 411 of the sleeve member 41 so as to move the sleeve member 41 to the open position against the basing action of the restoring member 42. At this time, the inner surface of the convergent segment 413 is in contact with the pin 322 of the actuating rod assembly 32 of the control valve unit 3, and pushes the pin 322 to move the rod 321 and the valve member 31 to unblock the flow path 22, so as to permit air to flow into the main body 21.

Figure 17:
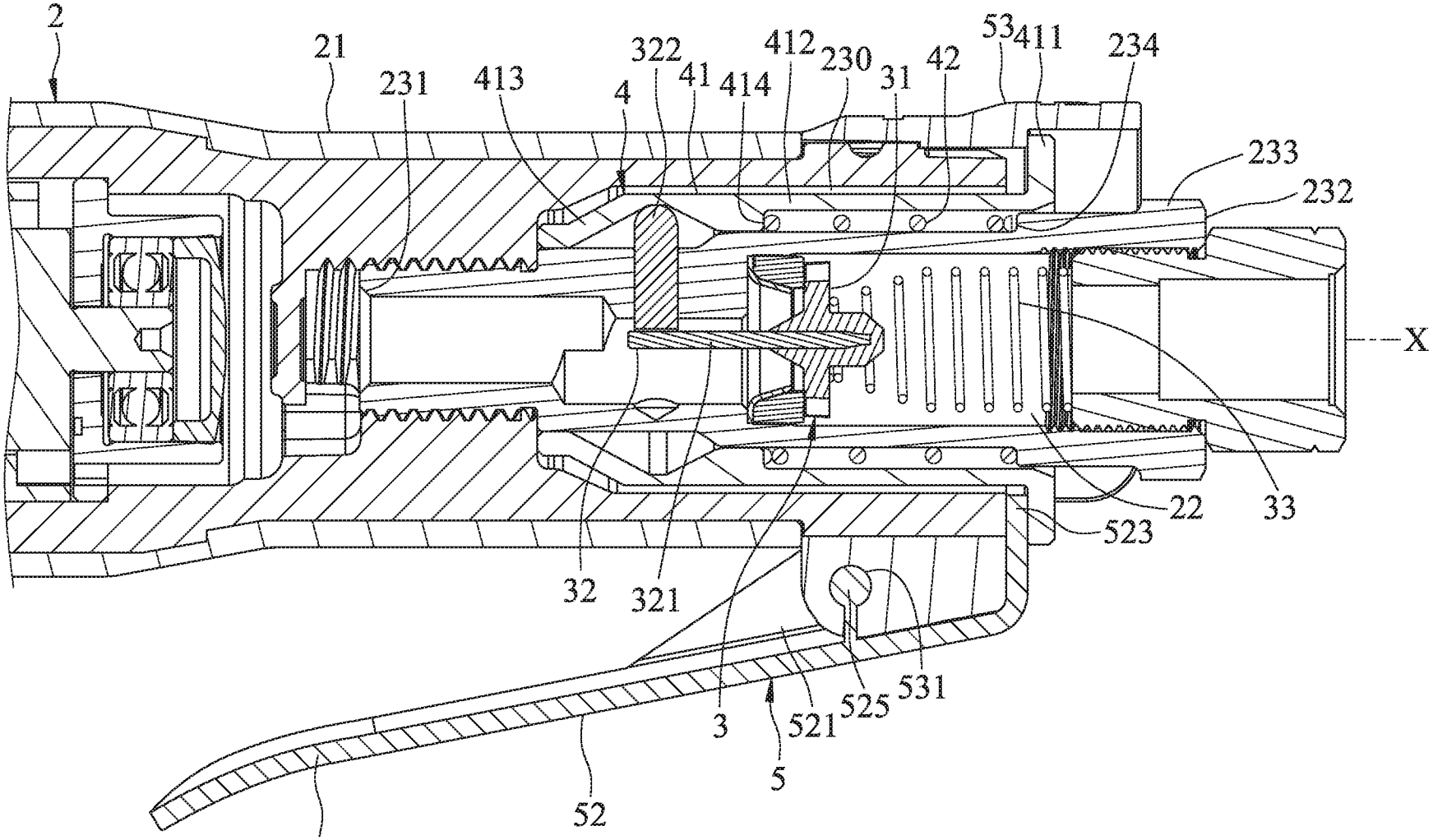
FIG. 17 is a schematic fragmentary sectional view illustrating a fourth embodiment of the pneumatic tool according to the disclosure where a sleeve member is at a block position.
Figure 18:
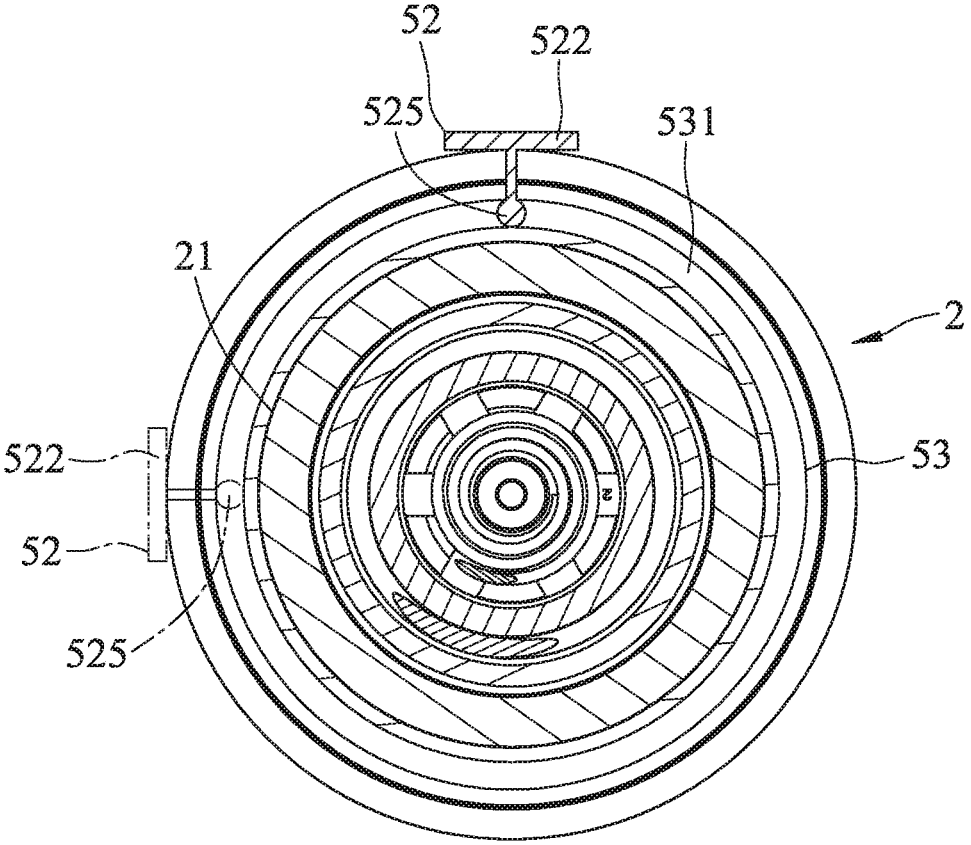
FIG. 18 is a schematic sectional view illustrating a trigger member of the fourth embodiment being movable along an annular groove.

Referring to FIGS. 17 and 18, the fourth embodiment of the pneumatic tool according to the disclosure is similar to the first embodiment, and includes a main body unit 2, a control valve unit 3, a switch unit 4 and a trigger unit 5.

The trigger unit 5 further includes an annular mounting member 53 that is fixedly mounted to the main body 21. The annular mounting member 53 has an annular groove 531 (see FIG. 18) that is formed in an outer surface of the annular mounting member 53. The trigger member 52 has a ball-shaped connecting portion 525 that is movable along the annular groove 531, and an operating portion 522 and an actuating portion 523 that are respectively located at two opposite sides of the ball-shaped connecting portion 525. The operating portion 522 is operable to pivot relative to the main body 21 about the center of the ball-shaped connecting portion 525 between a released position (see FIG. 17) where the operating portion 522 is distal from the main body 21, and a pressed position (not shown) where the operating portion 522 is proximate to the main body 21.

By such, the position of the trigger member 52 relative to the main body 21 can be easily adjusted by moving the ball-shaped connecting portion 525 of the trigger member 52 along the annular groove 531 of the annular mounting member 53.

The advantages of this disclosure are as follows:

1. By virtue of the sleeve member 41 that controls that valve unit 3 and that is mounted within the main body 21, the pin 322 of the valve unit 3 need not be located on the moving path of the trigger member 52, so the trigger member 52 can be easily mounted to the main body 21 regardless of the relative angular position thereof.

2. By virtue of the operation of the bolt member 61 of the positioning unit 6 or movement of the trigger member 52 along the annular groove 531 (see FIG. 18), the position of the trigger member 52 relative to the main body 21 can be easily adjusted for various demands.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A pneumatic tool comprising:

a main body unit having a flow path that extends from a rear end of said main body unit toward a front end of said main body unit for guiding inflow of air, and an annular space that surrounds said flow path;

a control valve unit disposed at said main body unit for removably blocking said flow path;

a switch unit including a sleeve member that surrounds said control valve unit and that is movably disposed in said annular space, said sleeve member being movable relative to said main body unit between an open position where said control valve unit is driven to unblock said flow path, and a block position where said control valve unit is driven to block said flow path, said sleeve member being configured to move away from said main body unit from the block position to the open position; and a trigger unit including a trigger member that is disposed on an outer surface of said main body unit and that is operable to move said sleeve member of said switch unit between the open position and the block position.

2. The pneumatic tool as claimed in claim 1, wherein said trigger member has an operating portion and an actuating portion that are respectively located at two opposite ends thereof, said operating portion being for being pressed, said actuating portion abutting against said sleeve member for moving said sleeve member toward the open position.

3. The pneumatic tool as claimed in claim 2, wherein said sleeve member has a flange segment that is located at a rear end thereof, said actuating portion of said trigger member abutting against said flange segment of said sleeve member.

4. The pneumatic tool as claimed in claim 2, wherein said trigger member further has a pivoted portion that is located between said operating portion and said actuating portion and that is pivoted relative to said main body unit, said operating portion of said trigger member being operable to pivot relative to said main body unit about a pivoted point of said pivoted portion between a released position where said operating portion is distal from said main body unit, and a pressed position where said operating portion is proximate to said main body unit.

5. The pneumatic tool as claimed in claim 2, wherein said trigger unit further includes an annular rotating member that rotatably surrounds said main body unit, said trigger member further having a pivoted portion that is located between said operating portion and said actuating portion and that is pivoted to said annular rotating member, said operating portion of said trigger member being operable to pivot relative to said main body unit about a pivoted point of said pivoted portion between a released position where said operating portion is distal from said main body unit, and a pressed position where said operating portion is proximate to said main body unit.

6. The pneumatic tool as claimed in claim 5, wherein said annular rotating member is formed with an opening, said actuating portion of said trigger member being C-shaped and extending into said opening.

7. The pneumatic tool as claimed in claim 2, wherein said trigger unit further includes an annular rotating member that rotatably surrounds said main body unit and that has a slide groove formed in an inner surface of said annular rotating member, said trigger member further having a connecting portion that is movable within said slide groove and that is located between said operating portion and said actuating portion, said operating portion being operable to move relative to said main body unit between a released position where said sleeve member is at the block position, and a pressed position where said sleeve member is at the open position.

8. The pneumatic tool as claimed in claim 5, further comprising a positioning unit, said main body unit further having a plurality of angularly spaced-apart positioning grooves that are formed in said outer surface thereof, said annular rotating member of said trigger unit further having a mounting hole that is operable to be aligned with a selective one of said positioning grooves, said positioning unit including a bolt member that is movably mounted to said annular rotating member, and a ball member that is movably disposed in said mounting hole of said annular rotating member, said bolt member having a recess that is formed in an outer surrounding surface thereof, and being movable between a fixing position where said recess is misaligned from said mounting hole, and an adjusting position where said recess is aligned with said mounting hole, wherein when said bolt member is at the fixing position, said ball member is pushed by said outer surrounding surface of said bolt member to engage with the selective one of said positioning grooves that is registered with said mounting hole so as to prevent said annular rotating member from rotating relative to said main body unit, wherein when said bolt member is at the adjusting position, said ball member is permitted to disengage from the selective one of said positioning grooves that is registered with said mounting hole and moves into said recess, so that said annular rotating member is permitted to rotate relative to said main body unit.

9. The pneumatic tool as claimed in claim 8, wherein said positioning unit further includes a resilient member that has two opposite ends respectively abut against said annular rotating member and said bolt member for resiliently biasing said bolt member toward the fixing position.

10. The pneumatic tool as claimed in claim 2, wherein said trigger unit further includes an annular mounting member that is mounted to said main body unit, said annular mounting member having an annular groove that is formed in an outer surface of said annular mounting member, said trigger member further having a ball-shaped connecting portion that is movable along said annular groove and that is located between said operating portion and said actuating portion, said operating portion is operable to pivot relative to said main body unit about the center of said ball-shaped connecting portion between a released position where said operating portion is distal from said main body unit, and a pressed position where said operating portion is proximate to said main body unit.

11. The pneumatic tool as claimed in claim 1, wherein said sleeve member has a main segment, and a convergent segment that is connected to an end of said main segment, the inner diameter of said end of said main segment being greater than the inner diameter of said convergent segment, said control valve unit corresponding in position to an inner surface of said end of said main segment when said sleeve member is at the block position, said control valve unit corresponding in position to and being in contact with an inner surface of said convergent segment when said sleeve member is at the open position, so as to be pushed to unblock said flow path.

12. The pneumatic tool as claimed in claim 11, wherein said main body unit includes a hollow main body, and a tubular member that is surrounded by said main body, that surrounds an axis, and that defines said flow path, said tubular member cooperating with said main body to define said annular space therebetween.

13. The pneumatic tool as claimed in claim 12, wherein said control valve unit includes a valve member that removably blocks said flow path of said main body unit, an actuating rod assembly that is coupled to said valve member and that is driven by said sleeve member, and a basing member that is connected to said valve member and that is disposed in said tubular member for resiliently biasing said valve member to block said flow path.

14. The pneumatic tool as claimed in claim 13, wherein said actuating rod assembly includes a rod that is co-movably connected to said valve member and that extends along the axis, and a pin that is movably mounted to said tubular member and that has an end abutting against said rod and an opposite end extending out from said tubular member, said pin of said control valve unit corresponding in position to said inner surface of said end of said main segment and being not in contact with said inner surface of said end of said main segment when said sleeve member is at the block position, said pin of said control valve unit corresponding in position to and being in contact with said inner surface of said convergent segment when said sleeve member is at the open position, so as to be pushed to move said rod and said valve member to unblock said flow path.

15. The pneumatic tool as claimed in claim 12, wherein said switch unit further includes a restoring member, said restoring member having two opposite ends respectively abutting against said tubular member and said sleeve member, and resiliently biasing said sleeve member toward the block position.

16. The pneumatic tool as claimed in claim 12, wherein said tubular member has a stop flange that extends radially and outwardly from an outer surface thereof and that is for limiting the movement of said sleeve member relative to said tubular member.

17. The pneumatic tool as claimed in claim 7, further comprising a positioning unit, said main body unit further having a plurality of angularly spaced-apart positioning grooves that are formed in said outer surface thereof, said annular rotating member of said trigger unit further having a mounting hole that is operable to be aligned with a selective one of said positioning grooves, said positioning unit including a bolt member that is movably mounted to said annular rotating member, and a ball member that is movably disposed in said mounting hole of said annular rotating member, said bolt member having a recess that is formed in an outer surrounding surface thereof, and being movable between a fixing position where said recess is misaligned from said mounting hole, and an adjusting position where said recess is aligned with said mounting hole, wherein when said bolt member is at the fixing position, said ball member is pushed by said outer surrounding surface of said bolt member to engage with the selective one of said positioning grooves that is registered with said mounting hole so as to prevent said annular rotating member from rotating relative to said main body unit, wherein when said bolt member is at the adjusting position, said ball member is permitted to disengage from the selective one of said positioning grooves that is registered with said mounting hole and moves into said recess, so that said annular rotating member is permitted to rotate relative to said main body unit.

18. The pneumatic tool as claimed in claim 17, wherein said positioning unit further includes a resilient member that has two opposite ends respectively abut against said annular rotating member and said bolt member for resiliently biasing said bolt member toward the fixing position.

19. The pneumatic tool as claimed in claim 1, wherein said sleeve member is proximate to said rear end of said main body unit when being at the open position, and is distal from said rear end of said main body unit when being at the block position.

* * * * *